US006648315B1

(12) United States Patent
Lee

(10) Patent No.: US 6,648,315 B1
(45) Date of Patent: Nov. 18, 2003

(54) CLAMPING DEVICE HAVING INDIRECT DRIVING MECHANISM

(76) Inventor: Yung Jen Lee, 2F, No. 10, Kan Leh St., West District, Taichung (TW), 403

( * ) Notice: Subject to any disclaimer, the term of this patent is extended or adjusted under 35 U.S.C. 154(b) by 0 days.

(21) Appl. No.: 10/295,327

(22) Filed: Nov. 14, 2002

(51) Int. Cl.[7] ..... B25B 5/02
(52) U.S. Cl. ..... 269/6; 269/170; 269/166
(58) Field of Search ..... 269/6, 228, 249, 269/216, 143, 3; 254/108; 222/325, 326, 327, 391

(56) References Cited

U.S. PATENT DOCUMENTS 4,926,722 A * 5/1990 Sorensen et al. ..... 81/487
5,156,305 A 10/1992 Eyre
5,217,213 A 6/1993 Lii
5,222,420 A * 6/1993 Sorensen et al. ..... 81/487
6,367,787 B1 * 4/2002 Poole et al. ..... 269/6

* cited by examiner

*Primary Examiner*—Joseph J. Hail, III
*Assistant Examiner*—Daniel Shanley

(57) ABSTRACT

A clamping device includes a rod slidably received in a channel of a housing, a catch plate and a release panel slidably engaged onto the rod and biased to be released and engaged onto the rod. A hand grip is pivotally secured to the housing, a pawl is rotatably secured in the housing and has one end engageable with the hand grip and the other end engageable with the catch plate to tilt the catch plate relative to the rod and for allowing the rod to be moved relative to the housing by the hand grip and the pawl. A knob may move and release the release panel relative to the rod.

9 Claims, 4 Drawing Sheets

CLAMPING DEVICE HAVING INDIRECT DRIVING MECHANISM

BACKGROUND OF THE INVENTION

1. Field of the Invention

The present invention relates to a clamping device, and more particularly to a clamping device having an indirect driving mechanism.

2. Description of the Prior Art

Various kinds of typical clamping devices, particularly the C-shaped clamping devices have been developed for dispensing various materials that are received in cylindrical receptacles or cartridges.

U.S. Pat. No. 5,156,305 to Eyre discloses one of the typical clamping devices having a supporting member for supporting the cylindrical receptacles or cartridges therein, and a rack or push rod advanceable along the supporting member. A handle is pivotally secured to the supporting member and has a plate engaged onto the push rod for moving the push rod forwardly step by step by pulling or forcing the handle toward the supporting member.

However, the plate is directly attached onto the handle and may be disengaged from push rod right away at the moment when the handle is pulled or forced toward the supporting member, such that the push rod may be pushed forwardly by the plate for only a short moving stroke. In addition, the plate may not be easily assembled or engaged onto the push rod.

U.S. Pat. No. 5,217,213 to Lii discloses another typical clamping device having a spring-biased pawl engaged with the push rod, for moving the push rod forwardly step by step by pulling or forcing the handle toward the supporting member. However, it will be difficult to release the push rod.

The present invention has arisen to mitigate and/or obviate the afore-described disadvantages of the conventional clamping devices.

SUMMARY OF THE INVENTION

The primary objective of the present invention is to provide a clamping device including an indirect driving mechanism.

The other objective of the present invention is to provide a clamping device including a slidable jaw attached onto the rod and movable toward the support for reducing the volume of the clamping device.

The further objective of the present invention is to provide a clamping device including a mechanism for easily releasing the rod.

In accordance with one aspect of the invention, there is provided a clamping device comprising a housing including an upper portion having a channel formed therein, and including a lower portion having a handle provided thereon, a rod slidably received in the channel of the housing, a catch plate and a release panel each having an orifice formed therein for slidably receiving the rod, and for slidably engaging the catch plate and the release panel onto the rod, a first biasing means for biasing the catch plate toward the ring and to release the catch plate relative to the rod, a second biasing means for tilting the release panel relative to the rod and to releasably lock the rod to the housing, a hand grip pivotally secured to the housing with a pivot shaft, and including a seat provided thereon, and a pawl rotatably secured in the housing, and including a first end engageable with the seat of the hand grip, and a second end engageable with the catch plate to tilt the catch plate relative to the rod against the first biasing means. The rod may thus be moved relative to the housing step by step by pulling the hand grip relative to the housing, and to force the pawl to engage with the catch plate.

The housing includes a first jaw provided thereon, the rod includes a second jaw provided thereon and movable toward the first jaw when the rod is moved relative to the housing. The housing is not required to provide any support structure to support the second jaw to the housing, such that the volume of the clamping device may be reduced.

A device may further be provided for releasing the release panel relative to the rod, and includes a knob pivotally secured to the housing and having a portion engageable with the release panel, to force the release panel against the second biasing means when the knob is moved relative to the housing.

A ring may further be provided and engaged onto the rod and engaged between the catch plate and the second biasing means, for preventing the second biasing means from biasing against the catch plate.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
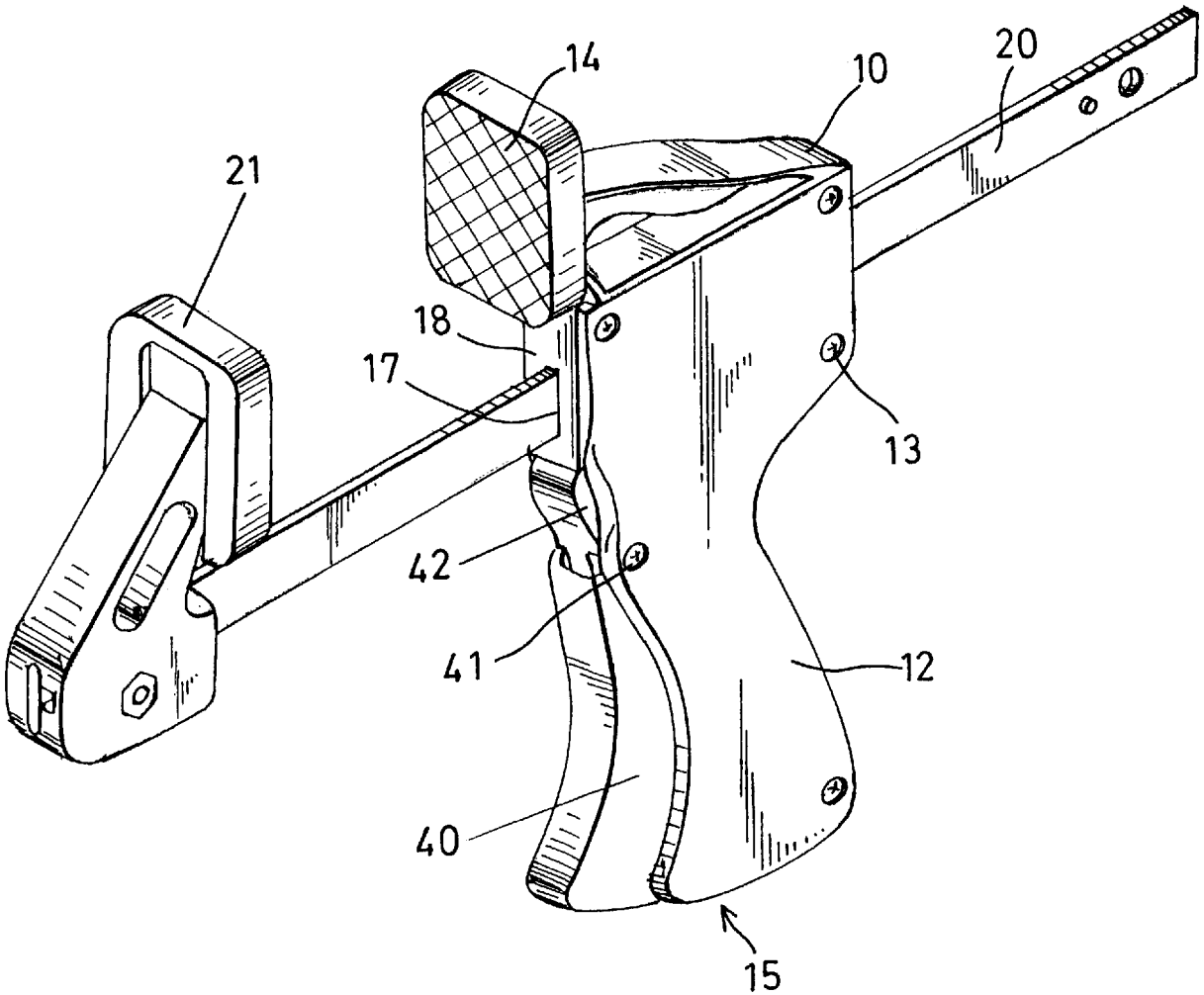
FIG. 1 is a perspective view of a clamping device in accordance with the present invention.
Figure 2:
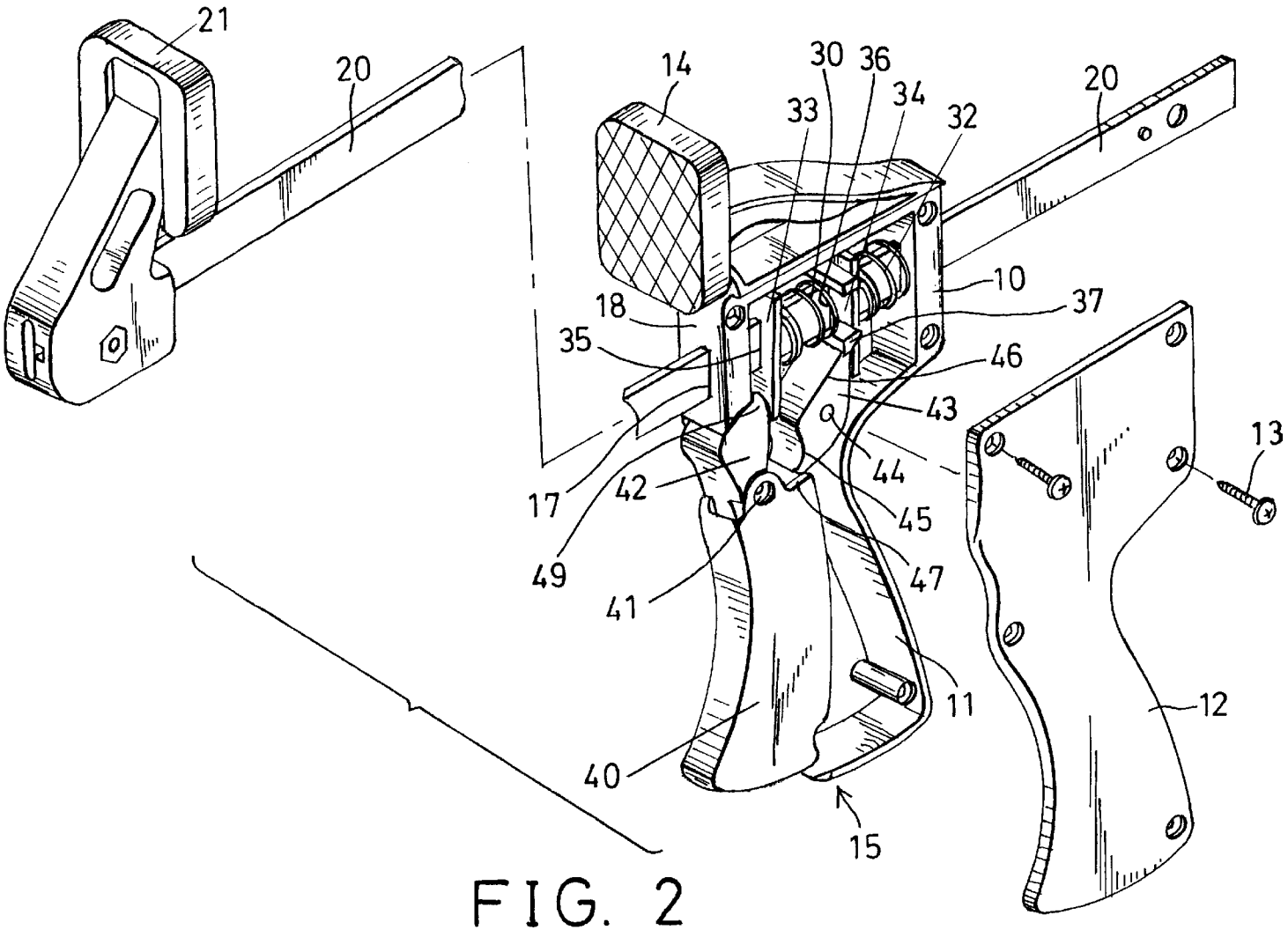
FIG. 2 is a partial exploded view of the clamping device.
Figure 3:
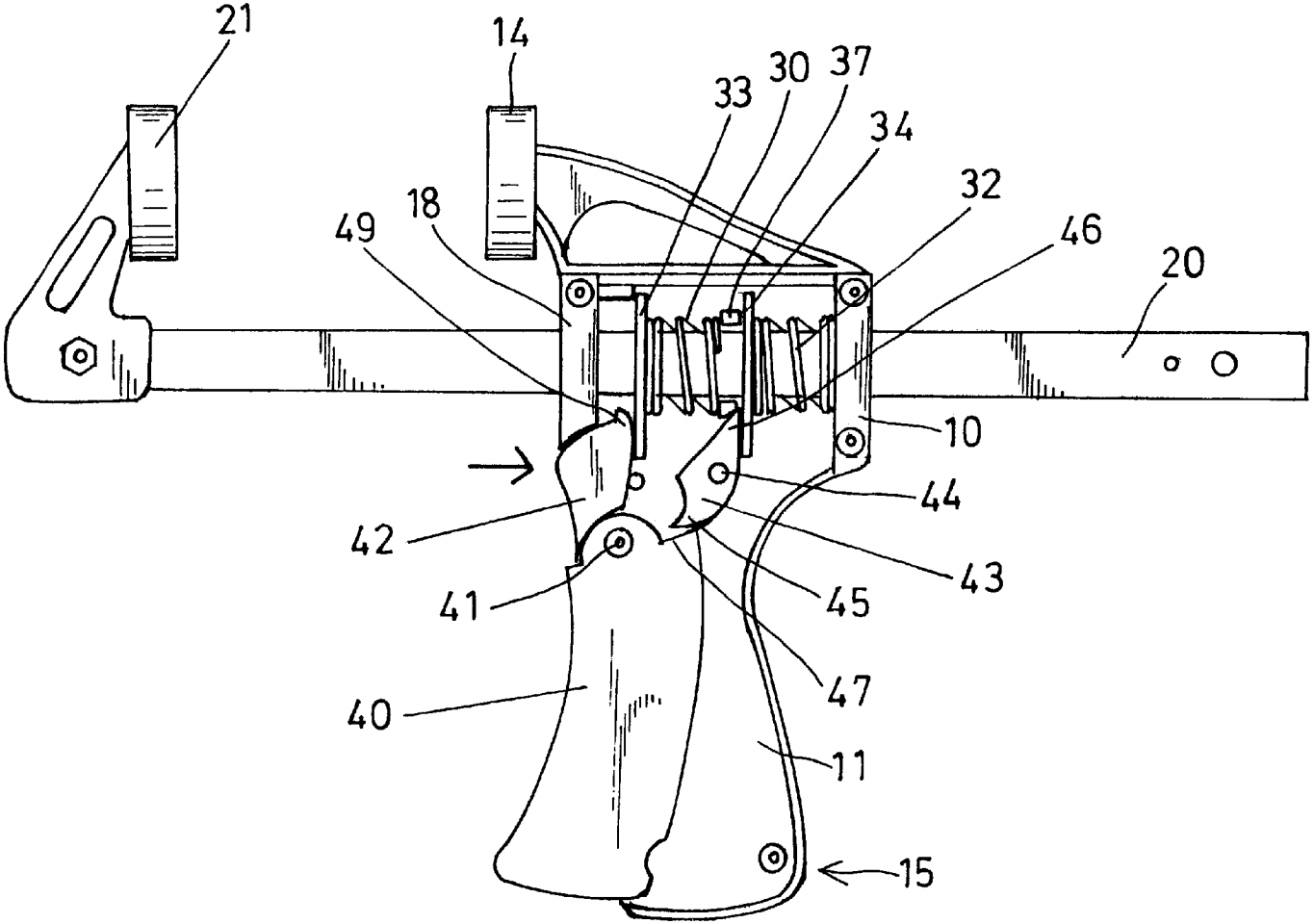
FIG. 3 is a side schematic view of the clamping device.

Referring to the drawings, and initially to FIGS. 1–3, a clamping device in accordance with the present invention comprises a support body or a housing 10 including a chamber 11 formed therein, a cover 12 detachably secured to the housing 10 with such as fasteners 13, for enclosing the chamber 11.

The housing 10 includes a fixed jaw 14 provided or formed on top thereof, and includes a handle 15 formed or provided on the lower portion thereof, and includes a channel 17 laterally formed in the upper portion thereof.

A push rod or a rack or a rod 20 is slidably received in the channel 17 of the housing 10, and includes another jaw 21 secured on one end thereof, such as the front end thereof, and movable toward and away from the fixed jaw 14 when the rod 20 is moved relative to the housing 10.

Two springs 30, 32, such as the coil springs 30, 32 are movably or slidably engaged onto the rod 20 and received in the chamber 11 of the housing 10. A release panel 33 and a catch plate 34 are received in the chamber 11 of the housing 10, and each has an orifice 35, 36 formed therein for slidably receiving the rod 20, and for movably or slidably engaging onto the rod 20.

The release panel 33 is disposed between the front spring 30 and a front wall 18 of the housing 10, and the spring 30 may be a spring biasing device to bias or to tilt the release panel 33 relative to the rod 20 (FIG. 4), in order to releasably clamp or to lock the rod 20 to the housing 10.

Figure 4:
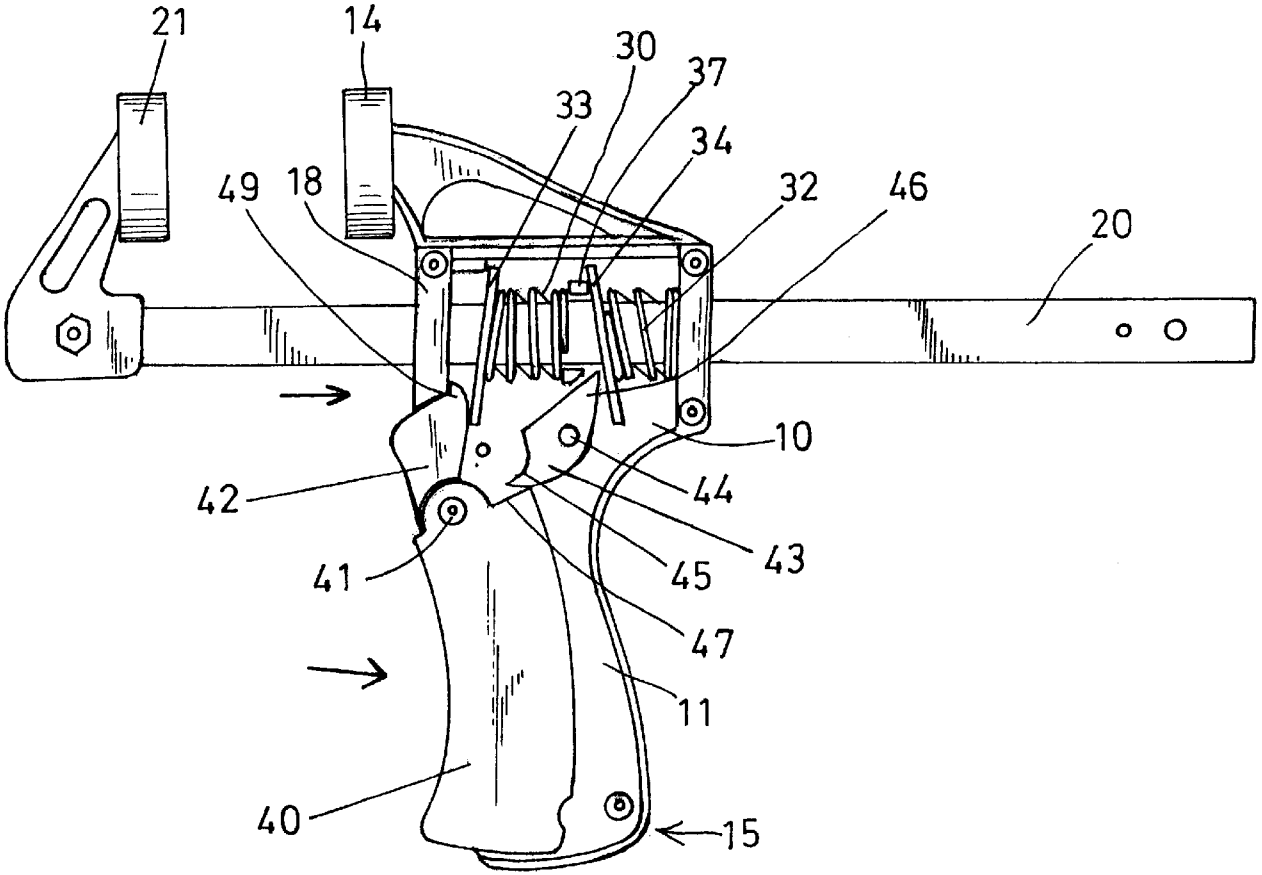
FIG. 4 is a side schematic view similar to FIG. 3, illustrating the operation of the clamping device.

The catch plate 34 is disposed between the springs 30, 32, and a ring 37 is also disposed onto the rod 20 and engaged between the catch plate 34 and the spring 30, for preventing the catch plate 34 from being biased or forced or tilted relative to the rod 20 by the spring 30 (FIG. 4).

The other spring 32 is engaged between the housing 10 and the catch plate 34, and is arranged as another spring biasing device to force against the catch plate 34, in order to bias or to force the catch plate 34 toward or to engage with the ring 37 (FIG. 3), and to force the catch plate 34 to a position perpendicular to the rod 20, and to release the catch plate 34 relative to the rod 20.

A hand grip 40 has an upper portion rotatably or pivotally secured to the housing 10 with a pivot shaft 41, for allowing the hand grip 40 to be moved or pulled toward the housing 10, particularly the handle 15 of the housing 10.

A pawl 43 is rotatably secured in the housing 10 with a pivot axle 44 and received in the chamber 11 of the housing 10, and includes one end or the lower end 45 engageable with the upper portion or the upper seat 47 of the hand grip 40, and the other end or the upper end 46 engageable with the catch plate 46.

In operation, as shown in FIG. 3, the spring 32 may bias the catch plate 34 toward or to engage with the ring 37, and may also force against the other end 46 of the pawl 43 to move or to force the hand grip 40 outwardly relative to the housing 10.

As shown in FIG. 4, when the hand grip 40 is moved or forced toward the handle 15, the end 47 of the pawl 43 may be engaged and forced by the seat 47 of the hand grip 40, in order to force such as the lower portion of the catch plate 34 relative to the rod 20, in order to tilt the catch plate 34 relative to the rod 20 against the spring 32, and so as to move the rod 20 relative to the housing 10.

When the hand grip 40 is released, the spring 32 may bias the catch plate 34 toward or to engage with the ring 37 again, and may also force against the other end 46 of the pawl 43 to move or to force the hand grip 40 outwardly relative to the housing 10. The rod 20 may thus be moved relative to the housing 10 step by step by pulling the hand grip 40 toward the handle 15 repeatedly.

A knob 42 includes such as a lower portion rotatably or pivotally secured to the housing 10 with the pivot shaft 41, and the other portion, such as the upper portion 49 engageable with the release panel 33 for moving or forcing the release panel 33 against the spring 30 or toward the ring 37 (FIG. 3).

For example, as shown in FIG. 3, when the knob 42 is moved inwardly or into the housing 10, by such as the finger of the user, the knob 42 may engage with and may force the release panel 33 to a position perpendicular to the rod 20, and thus to release the release panel 33 relative to the rod 20. At this moment, the rod 20 may be moved freely relative to the release panel 33 and the housing 10.

In operation, as shown in FIG. 3, the knob 42 may be moved or depressed into or relative to the housing 10, in order to release the release panel 33, and thus for allowing the rod 20 to be moved relative to the housing 10, or to be moved forwardly or rearwardly relative to the housing 10, and thus for allowing the object to be clamped between the jaws 14, 21.

The hand grip 40 may be pulled or forced toward the handle 15 repeatedly in order to force the pawl 43 to engage with the catch plate 34, and to move the rod 20 relative to the housing 10 step by step. The rod 20 may be released and moved relative to the housing 10 by depressing the knob 42 relative to the housing 10.

It is to be noted that the jaw 21 is secured to the rod 20 and movable relative to the housing 10, such that the housing 10 does not need to provide a supporting structure to support the jaw 21, and such that the clamping device may include a reduced volume.

The pawl 43 is rotatably secured in the housing 10 and engageable between the hand grip 40 and the catch plate 34, for allowing the rod 20 to be indirectly moved relative to the housing 10 step by step by the catch plate 34 and the pawl 43. The release panel 33 may be easily released by moving a releasing device or the knob 42 with the finger of the user.

The provision and the engagement of the ring 37 between the spring 30 and the catch plate 34 may prevent the spring 30 from biasing against the catch plate 34, and for allowing the catch plate 34 to be biased or forced only by the other spring 32.

Accordingly, the clamping device in accordance with the present invention includes an indirect driving mechanism, and a slidable jaw attached onto the rod and movable toward the support for reducing the volume of the clamping device, and for allowing the rod to be easily released.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A clamping device comprising:

a housing including an upper portion having a channel formed therein, and including a lower portion having a handle provided thereon, a rod slidably received in said channel of said housing, a catch plate and a release panel each having an orifice formed therein for slidably receiving said rod, and for slidably engaging said catch plate and said release panel onto said rod, a first biasing means for biasing said catch plate toward said release panel and to release said catch plate relative to said rod, a second biasing means for tilting said release panel relative to said rod and to releasably lock said rod to said housing, a hand grip pivotally secured to said housing with a pivot shaft, and including a seat provided thereon, and a pawl rotatably secured in said housing, and including a first end engageable with said seat of said hand grip, and a second end engageable with said catch plate to tilt said catch plate relative to said rod against said first biasing means.

2. The clamping device according to claim 1, wherein said housing includes a first jaw provided thereon, said rod includes a second jaw provided thereon and movable toward said first jaw when said rod is moved relative to said housing.

3. The clamping device according to claim 1 further comprising means for releasing said release panel relative to said rod.

4. The clamping device according to claim 1, wherein said releasing means includes a knob pivotally secured to said housing and having a portion engageable with said release panel, to force said release panel against said second biasing means when said knob is moved relative to said housing.

5. The clamping device according to claim 1 further comprising a ring engaged onto said rod and engaged between said catch plate and said second biasing means, for preventing said second biasing means from biasing against said catch plate.

6. A clamping device comprising:

a housing including an upper portion having a channel formed therein, and including a lower portion having a handle provided thereon, a rod slidably received in said channel of said housing, a catch plate and a release panel each having an orifice formed therein for slidably receiving said rod, and for slidably engaging said catch plate and said release panel onto said rod, a first spring engaged onto said rod and engaged with said catch plate to bias said catch plate relative to said rod and to release said catch plate relative to said rod, a second spring engaged onto said rod and engaged with said release panel to tilt said release panel relative to said rod and to releasably lock said rod to said housing, a ring engaged onto said rod and engaged between said second spring and said catch plate, to prevent said catch plate from being biased by said second spring, and means for tilting said catch plate relative to said rod against said first spring, to engage said catch plate with said rod and to move said rod relative to said housing, said tilting means includes a hand grip pivotally secured to said housing with a pivot shaft and having a seat provided thereon, a pawl rotatable secured in said housing and having a first end engageable with said seat of said hand grip and a second end engageable with said catch plate to tilt said catch plate relative to said rod against said first spring when said hand grip is moved relative to said housing.

7. The clamping device according to claim 6 further comprising means for releasing said release panel relative to said rod.

8. The clamping device according to claim 7, wherein said releasing means includes a knob pivotally secured to said housing and having a portion engageable with said release panel, to force said release panel against said second spring when said knob is moved relative to said housing.

9. The clamping device according to claim 6, wherein said housing includes a first jaw provided thereon, said rod includes a second jaw provided thereon and movable toward said first jaw when said rod is moved relative to said housing.

* * * * *